US007370420B2

(12) United States Patent
Shimizu

(10) Patent No.: US 7,370,420 B2
(45) Date of Patent: May 13, 2008

(54) ROTARY ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 174 days.

(21) Appl. No.: 11/435,965

(22) Filed: May 17, 2006

(65) Prior Publication Data

US 2006/0260130 A1 Nov. 23, 2006

(30) Foreign Application Priority Data

May 18, 2005 (JP) ..... 2005-145013

(51) Int. Cl.
*B26B 19/14* (2006.01)

(52) U.S. Cl. ..... 30/43.4; 30/346.51

(58) Field of Classification Search ..... 30/43.1–43.6, 30/346.51

See application file for complete search history.

(56) References Cited

U.S. PATENT DOCUMENTS 2,077,806 A * 4/1937 Muros ..... 30/43.3
2,900,720 A * 8/1959 Bakker et al. ..... 30/43.5
3,844,033 A * 10/1974 Yonkers ..... 30/43.5
3,913,225 A * 10/1975 Tietjens et al. ..... 30/43.6
4,038,748 A 8/1977 Tyler et al.
5,625,950 A 5/1997 Sterk et al.
6,145,200 A * 11/2000 Jorna et al. ..... 30/43.6
7,222,428 B2 * 5/2007 Koike ..... 30/43.5

FOREIGN PATENT DOCUMENTS

| | | |
|---|---|---|
| EP | 1 208 951 | 5/2002 |
| JP | 2-213378 | 8/1990 |
| JP | 6-31660 | 4/1994 |

* cited by examiner

*Primary Examiner*—Kenneth E. Peterson
*Assistant Examiner*—Phong Nguyen
(74) *Attorney, Agent, or Firm*—William L. Androlia; H. Henry Koda

(57) ABSTRACT

A cutter unit of a rotary shaver including: a cutter receiving stage 90 held by an outer cutter housing 18 and coaxially penetrated by a drive shaft 26, a pivot case holder 50 held by the cutter receiving stage to be movable upward and downward and having a case supporting portion 58 below an outer cutter 14, a bowl-shaped pivot case 48 held by the pivot case holder 50 to make sliding contact with the case supporting portion 58 of the pivot case holder, the pivot case 48 being pivotable in any direction and surrounding the lower portion of an inner cutter 40, an outer cutter ring 76 provided on the pivot case 48 and in which the flange of the outer cutter is secured, and a return spring 70 for returning the pivot case 48 to be coaxial with the drive shaft.

9 Claims, 9 Drawing Sheets

ROTARY ELECTRIC SHAVER

BACKGROUND OF THE INVENTION

1. Field of the Invention

The present invention relates to a rotary electric shaver that rotates an inner cutter while making sliding contact with a substantially disk-shaped outer cutter, thus cutting hair (whiskers, etc.) that enters slits in the outer cutter by the rotating inner cutter.

2. Description of the Related Art

In electric rotary shavers having a single or a plurality outer cutters, it is well known that the shaving feeling improves if the outer cutter(s) is designed to be movable upward and downward (or to be floatable) in an axial direction thereof. In addition, by way of designing the outer cutter to not only be movable upward and downward but also be tiltable in an arbitrary direction so that the outer cutter tilts to follow the curvature of the shaving surface, the closeness between the outer cutter and the shaving surface increases, and the shaving feeling improves even more.

Japanese Patent Application National Publication No. H09-503424 that corresponds to U.S. Pat. No. 5,625,950 discloses an outer cutter(s) that is movable upward and downward and is tiltable in an arbitrary direction. In this prior art, a skin supporting rim (outer cutter ring) that surrounds the outer periphery of the outer cutter is provided, a projecting part that projects outwardly from the outer cutter is also provided in this skin supporting rim, and this projecting part turnably engages the engagement surface of the outer cutter holder (outer cutter housing). In other words, the skin supporting rim (outer cutter ring) that surrounds the outer cutter is provided so that it pivots with respect to both the outer cutter holder and the outer cutter. This skin supporting rim functions so that when the outer cutter is strongly pressed against the skin, it prevents the outer peripheral edge of the outer cutter from sinking deeply into the skin and shaving too deeply and damaging the skin.

Japanese Patent Application Laid-Open (Kokai) No. H02-213378 discloses an integrated cutter head and motor, and the cutter head and motor are provided so as to be pivotable in an arbitrary direction with respect to the shaver main body. The cutter head housing and the shaver main body are respectively formed as a spherical shell and a spherical cap type bearing shell, and both of these shells are provided so as to be slidable with respect to one another.

In Japanese Utility Model Application Laid-Open (Kokai) H06-31660, as in Japanese Patent Application Laid-Open (Kokai) No. H02-213378, an integrated cutter head and a motor which pivots with respect to the shaver main body is disclosed. However, Japanese Utility Model Application Laid-Open (Kokai) H06-31660 differs from Japanese Patent Application Laid-Open (Kokai) No. H02-213378 in that the head is joined to the shaver main body by four link elements, and the motor is pressed in the outer cutter direction by a conical coil.

In the shaver of Japanese Patent Application National Publication No. H09-503424 (or the U.S. Pat. No. 5,625,950), the outer circumference of the skin supporting rim that surrounds the outer periphery of the outer cutter turnably engages the outer cutter holder. As a result, it is unavoidable that the distance between the outer cutter and the outer cutter holder that surrounds the outer cutter becomes larger in the diameter direction. Therefore, the cutter unit comprising a single outer cutter and inner cutter and their ancillary components and the cutter head become large in size. Also, in a shaver that has a plurality of cutter units, there is a problem that the spacing between each cutter unit widens, and the feeling of use becomes poor.

Also, in the shaver of Japanese Patent Application National Publication No. H09-503424 (or the U.S. Pat. No. 5,625,950), the inner cutter(s) rotates about an axis (indicated by K, A, A1, A2) that is parallel to the top surface of the outer cutter and are passing through the center of the outer cutter(s). Therefore, particularly if the shaver is designed so that the inner cutter is supported so as to be rotated only about one axis, when the skin pressure is applied to this rotating axis, the skin supporting rim cannot turn, causing the problem that the shaving operation cannot be done smoothly. In addition, since the entire skin supporting rim does not move upward and downward (or is not sinkable), the improvement of the feeling of shaving is limited.

In the shavers of Japanese Patent Application Laid-Open (Kokai) No. H02-213378 and Japanese Utility Model Application Laid-Open (Kokai) H06-31660, the cutter head and motor are integrated, and the entirety of these pivots with respect to the shaver main body. As a result, the pivoting portion is large in size, and the shaver head is also large in size. In addition, the outer cutters in these prior art have no play in the vertical direction (rotational axis direction of the inner cutter); as a result, when the outer cutter presses the skin firmly, the outer cutter sinks deeply inside the skin and cuts deeply, and there is danger of skin damage. In particular, unlike Japanese Patent Application National Publication No. H09-503424 (or the U.S. Pat. No. 5,625,950), since a skin supporting rim is not provided, deep shaving can easily occur.

BRIEF SUMMARY OF THE INVENTION

Accordingly, it is an object of the present invention to provide a rotary electric shaver that has an outer cutter ring functioning as a skin supporting rim without causing deep shaving or a burning sensation in the skin.

It is another object of the present invention to provide a rotary electric shaver that has a cutter unit of reduced dimension (in outer diameter), thus allowing the cutter head to be small and making a smooth operation possible.

It is still another object of the present invention to provide a rotary electric shaver in which the spacing between the cutter units when a plurality of cutter units are provided is made small, thus making the cutter head small and improving the feeling of use of the shaver.

The above objects are accomplished by a unique structure of the present invention for a rotary electric shaver that includes a cutter unit, in which the cutter unit holds a substantially disk-shaped outer cutter in an outer cutter housing installed at the upper portion of the shaver main body that houses therein a motor; and the cutter unit further allows an inner cutter, which is fitted in the outer cutter from below while being pressed elastically toward the outer cutter, to rotate with a drive shaft that is rotationally driven by the motor; and in the present invention, the cutter unit is comprised of:

- a cutter receiving stage that is held by the outer cutter housing and coaxially penetrated by the drive shaft,
- a pivot case holder that is held by the cutter receiving stage so as to be movable upward and downward in the axial direction of the drive shaft, the pivot case holder having a case supporting portion located on a hemispheric surface thereof that faces upward (or faces the outer cutter) from below the outer cutter, a substantially bowl-shaped pivot case that is held by the pivot case holder so as to make sliding contact with the case supporting portion of the pivot case holder, the pivot case being pivotable in an arbitrary direction and surrounding the lower portion of the inner cutter, an outer cutter ring that is detachably provided on the upper edge portion of the pivot case and in which the outer peripheral edge of the outer cutter is secured to the inside thereof, and a return spring that is compressedly provided between the pivot case and the cutter receiving stage so that the return spring returns the pivot case to a position coaxial with the drive shaft; and in this structure, the pivot case makes sliding contact with the case supporting portion of the pivot case holder so that the pivot case is pivotable together with the outer cutter, and the pivot case is movable upward and downward together with the pivot case holder.

In the present invention, the outer periphery of the outer cutter is surrounded by an outer cutter ring so as to be secured to the outer cutter ring (by a fixing ring), and this outer cutter ring having the outer cutter is provided on the pivot case, and the outer cutter, outer cutter ring and pivot case are provided so as to be movable together with the pivot case holder upward and downward in the axial direction with respect to the cutter receiving stage. Accordingly, the outer cutter is properly movable up and down in its axial direction and, as a result, it is unlikely that the outer peripheral edge (or flange) of the outer cutter sinks deeply into the skin to cause deep shaving and that a burning sensation occurs in the skin.

In addition, the outer cutter ring and the outer cutter are provided on the upper edge of the pivot case that covers the lower portion of the outer cutter and inner cutter from below, and this pivot case is provided so that it makes sliding contact with the case supporting portion of the pivot case holder provided below the outer cutter and inner cutter and is pivotable in an arbitrary direction. Accordingly, the pivot case pivots in an arbitrary direction on the spherical surface of the case supporting portion of the pivot case holder. The outer cutter is urged upward (or in the direction opposite from the cutter receiving stage 90) by the inner cutter, which is urged upward by the drive shaft, and by the return spring, which pushes up the pivot case. Accordingly, the outer cutter ring and the outer cutter can be moved upward and downward, or axially upward and downward, together with the inner cutter. As a result, the outer cutter and the outer cutter ring smoothly follow the contour of the skin during shaving, providing improved shaving feeling.

In particular, the outer cutter, the outer cutter ring, the pivot case and the pivot case holder are urged upward by the return spring. Accordingly, the upward urging force of the inner cutter caused by the drive shaft can be freely set regardless of the upward urging force exerted on the outer cutter by the return spring. In other words, the contact pressure between the inner cutter and the outer cutter and the upward return force of the outer cutter (or the elastic force when the outer cutter sinks) can be set individually. Therefore, the degree of design freedom is high.

Furthermore, in the present invention, the outer cutter is secured to the outer cutter ring, this outer cutter ring is provided on the pivot case, and the pivot case is pivotably held by the pivot case holder that is provided below the pivot case. As a result, the cutter unit does not have a large dimension in the direction of diameter of the outer cutter. In other words, the case supporting portion of the pivot case holder is not outside the diameter of the outer cutter, but it is within the diameter of the outer cutter and below the outer cutter. Therefore, the cutter head can be made smaller. Also, in a shaver that includes a plurality of cutter units, the spacing of such plurality of cutter units can be designed smaller or narrower, and the cutter head can be smaller with an improved feeling of use.

In addition, the pivot case holder is provided so that it is movable in upward and downward direction (with respect to axial direction of the drive shaft) within a predetermined range with respect to the cutter receiving stage. Accordingly, when downward pressure is not applied to the top surface of the outer cutter (or when the outer cutter is not pressed against the skin during shaving), the outer cutter and the outer cutter ring and the pivot case are pushed upward by the return spring, and the pivot case holder is pulled upward by the pivot case and stops at the upper limit position of the moveable range of the pivot case holder with respect to the cutter receiving stage. When, on the other hand, downward pressure is applied uniformly to the entire top surface of the outer cutter (or when the entire top surface of the outer cutter is pressed against the skin during shaving), the outer cutter, the outer cutter ring, the pivot case and the pivot case holder descend or are moved downward, while compressing the return spring, within the moveable range of the pivot case holder with respect to the cutter receiving stage and within the range of play of vertical movement of the pivot case with respect to the cutter receiving stage. Therefore, the entire outer cutter can sink downward, and excessive pressure on the skin is prevented, thus providing an improved feeling of use of the shaver.

In the present invention, the pivoting center of the pivot case—that is, the center of the hemispheric surface located in the case supporting portion of the pivot case holder—can be preferably positioned near the center of the top surface of the outer cutter. In this case, since the outer cutter pivots about the cutter axis line near the center of its top surface, pivoting of the outer cutter is smooth.

In addition, it is possible in the present invention to design so that the pivot case holder is provided with spherical plate parts that extend in the inner diameter direction substantially along its hemispheric surfaces that open upward, and tongue-shaped hooks that slideably engage the lower surface of the spherical plate part of the pivot case holder from the inside are provided in the pivot case that is held by the pivot case holder. In this structure, since the reaction force from the drive shaft that pushes the outer cutter upward is received by these hooks, the possible movement range of the outer cutter is enlarged, and the outer cutter can move smoothly.

In the present invention, the case supporting portion of the pivot case holder may have a rail shape along the circular arc in the diameter direction located on the hemispheric surface. With this structure, the sliding contact portion of the case supporting portion with respect to the pivot case follows the turning direction of the pivot case, and the pivot case pivot more smoothly.

Furthermore, in the present invention, the pivot case is formed with a tubular part that projects downward so that it passes through the inside of the spherical plate part of the pivot case holder, and a conical coil spring that is a return spring for returning the pivot case from its tilted position to the upright position is provided between the lower end of this tubular part and the pivot case holder. In this structure, the restoration force of the return spring applied to the pivot case is applied more downward than the pivoting spherical surface of the pivot case (the spherical surface where the case supporting portion rides). Thus, it is possible to generate sufficient restoration force to cancel the tilt of the pivot case and restore the pivot case to an upright position with a very simple structure.

In the present invention, a plurality of hooks can be provided in the pivot case in such a manner that they project upward from the inside with their tip ends bent inwardly to take a hook-like shape. These hooks prevent the inner cutter from coming out of the pivot case upwardly. Accordingly, the inner cutter is kept held in the pivot case when the outer cutter is taken out or removed from the pivot case to clean the area near the inner cutter. Therefore, the cutting edge of the inner cutter can be cleaned with the inner cutter held in the pivot case. The cleaning operability is thus excellent.

Furthermore, in the present invention, a plurality of cutter units can be provided in the outer cutter housing with the outer cutters, outer cutter rings and pivot cases of each cutter unit being provided in a freely movable manner upward and downward and in a freely pivotable manner in an arbitrary direction, independent of one another. This structure makes it possible to cut hair (whiskers, etc.) with good efficiency. Since each one of the outer cutters, outer cutter rings, and pivot cases is small in the diameter direction, the spacing between the outer cutters can be small, the shaving surface of the cutter head can be small, and the cutter head can be made small. It is thus easy to use the shaver. In the above structure, a plurality of cutter receiving stages that correspond to the number of the outer (and inner) cutters are formed into a single, integrated body. With the thus integrally formed cutter receiving stage, not only the number of components is reduced and assembly and disassembly can be made easily, but also the structure can be simple.

DETAILED DESCRIPTION OF THE INVENTION

Figure 1:
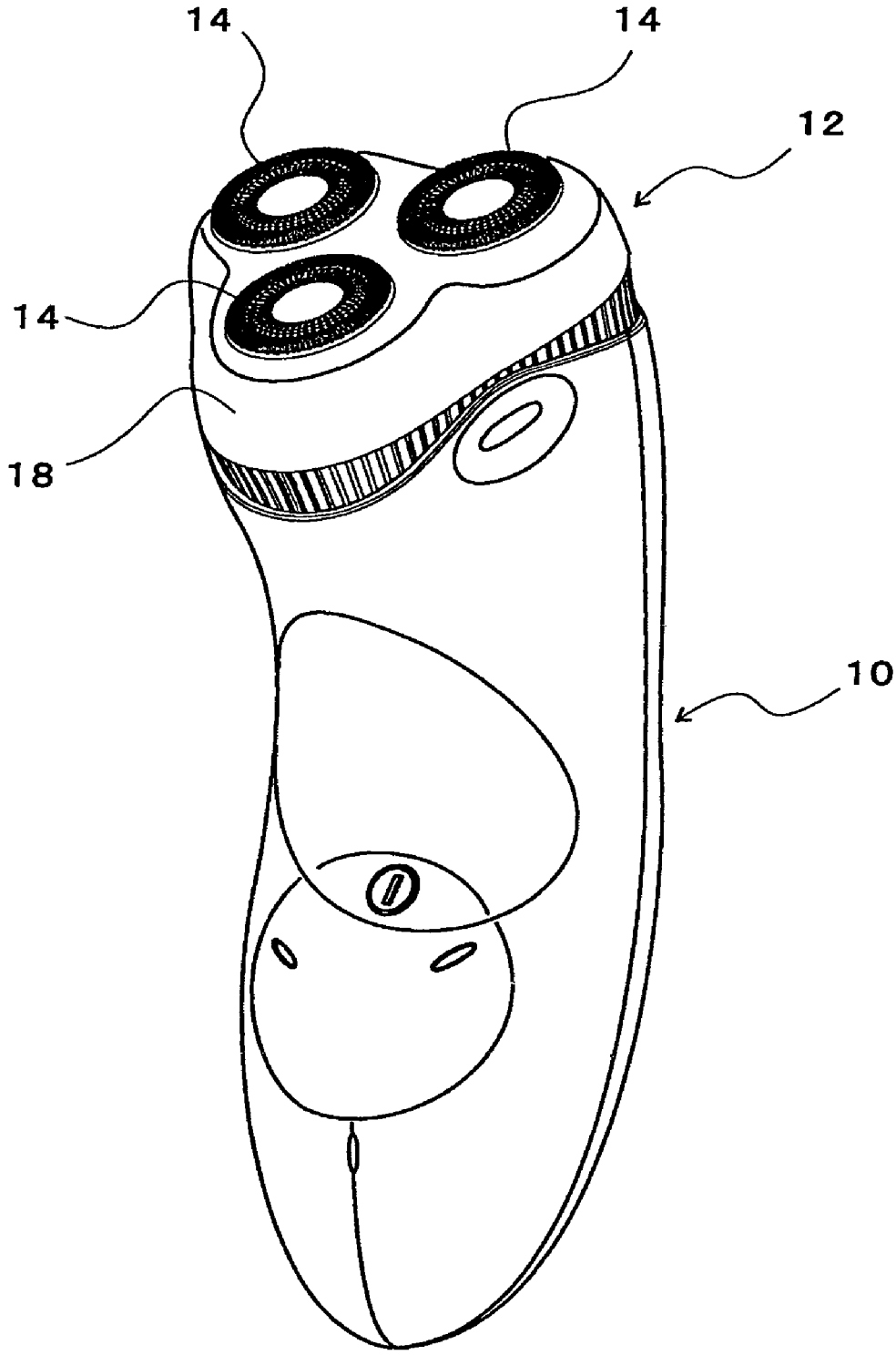
FIG. 1 is a perspective view of the shaver according to one embodiment of the present invention.

In FIG. 1, the reference numeral 10 is a shaver main body, and 12 is a cutter head openably or detachably attached to the top portion of the shaver main body 10. The cutter head 12 houses three cutter units 16 (see FIGS. 3 and 7), each comprising an outer cutter 14, a pivoting case 48, a pivot case holder 50, etc. The outer cutters 14 of the three cutter units 16 are positioned at the vertices of an equilateral triangle.

Figure 2:
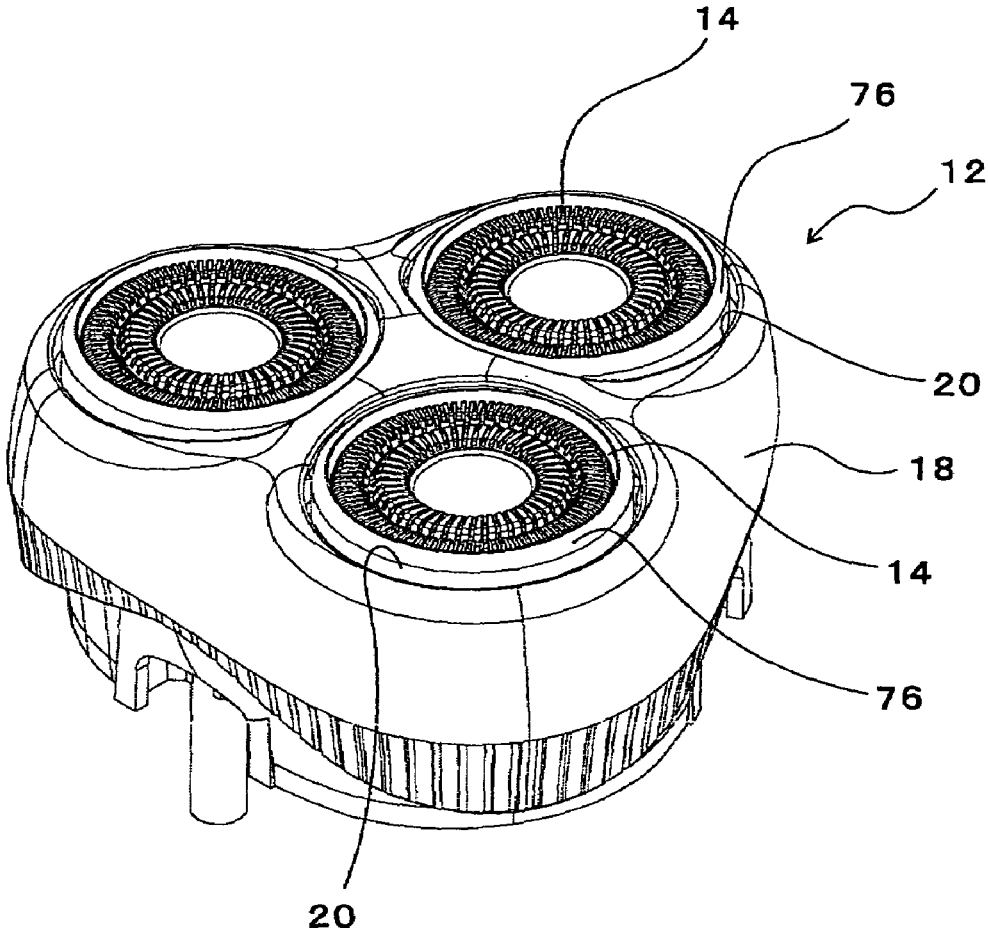
FIG. 2 is an enlarged perspective view of the cutter head of the shaver of FIG. 1.
Figure 3:
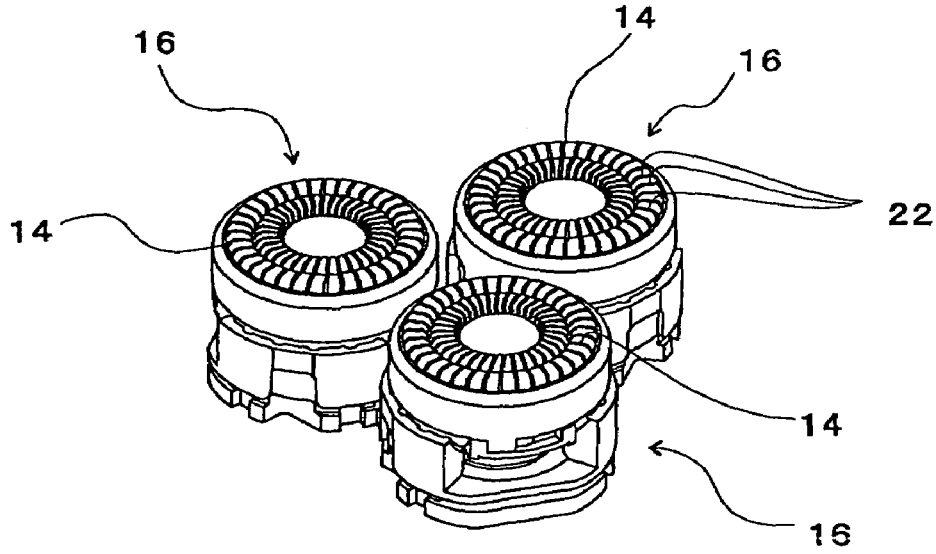
FIG. 3 is a perspective view of the three cutter units of the shaver of FIG. 1 seen obliquely from above.
Figure 5:
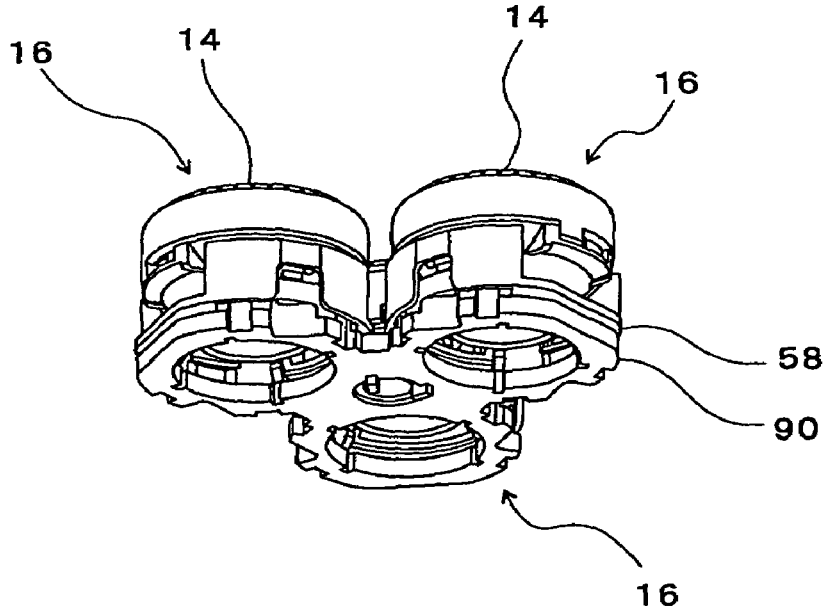
FIG. 5 is a perspective view of the three cutter units seen obliquely from below.
Figure 4:
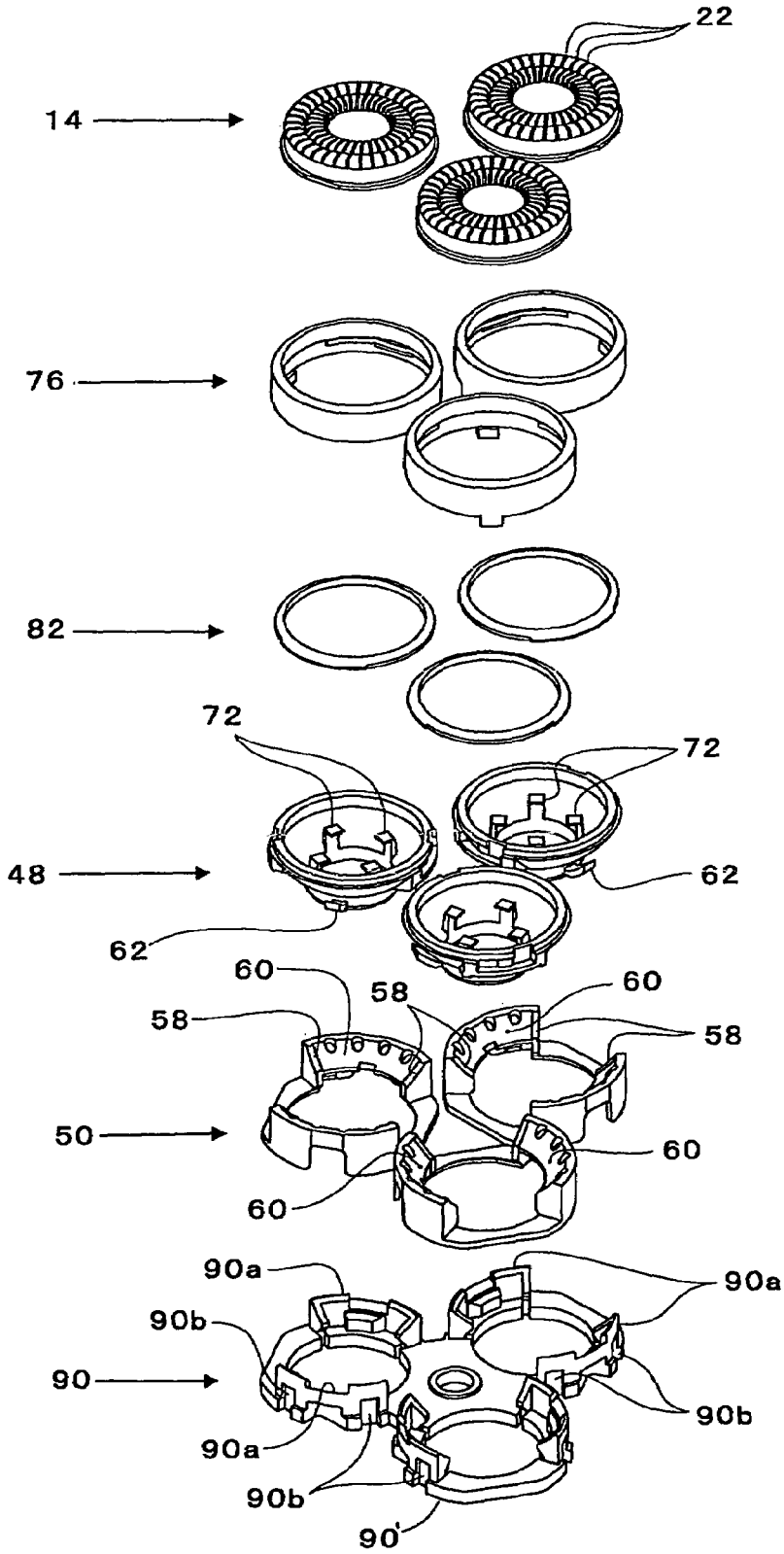
FIG. 4 is an exploded perspective view of the three cutter units seen obliquely from above.

The cutter head 12 has an outer cutter housing 18 that is openable or detachable upward (in the direction opposite from the shaver main body 10) with respect to the shaver main body 10. Three outer cutter installation holes 20 from which the outer cutters 14 can project are formed in the outer cutter housing 18 (see FIG. 2). Each of the outer cutters 14 is made of a metal and formed into a substantially disk-shaped shallow cup. A plurality of slits 22, as seen from FIGS. 3, 4 and 7, are formed in a substantially radial pattern in the circular portion of the outer cutter 14.

Figure 7:
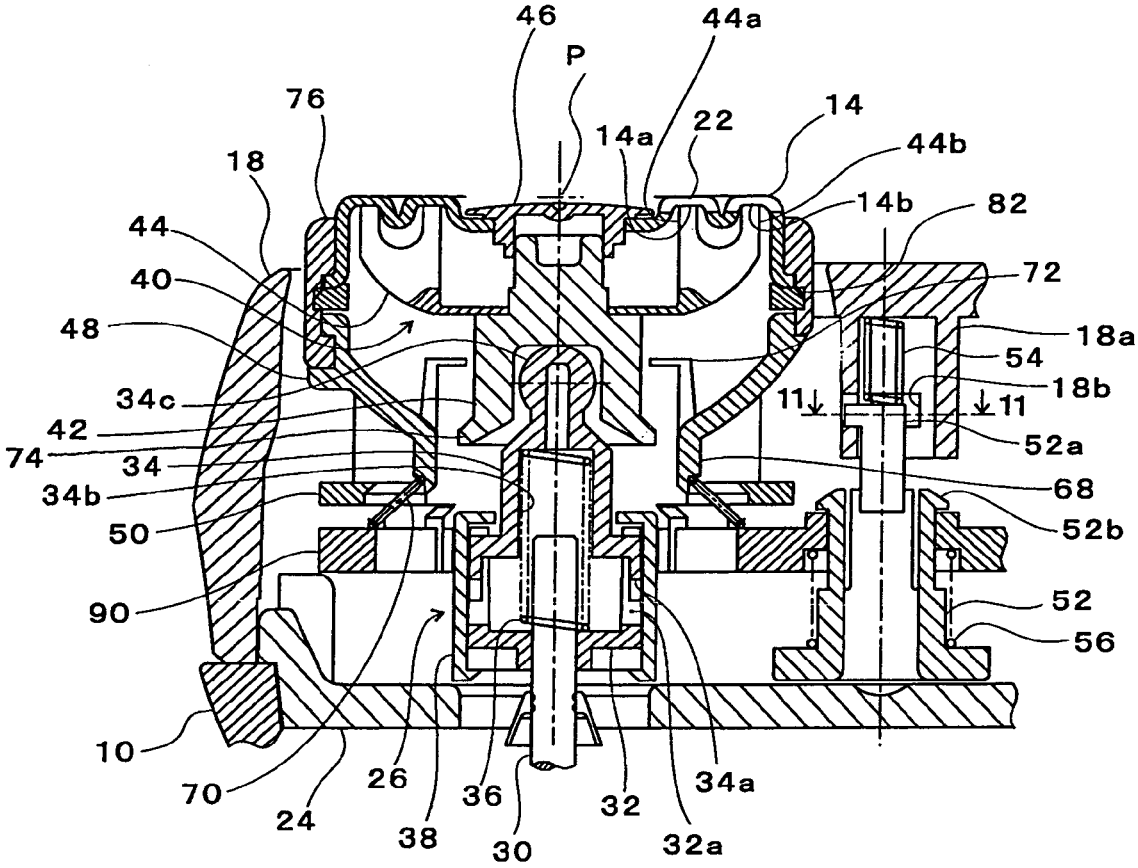
FIG. 7 is a vertical cross-sectional view of one cutter unit.

As seen from FIG. 7, a base plate 24, which is substantially a triangular shape, is fitted in the upper end of the shaver main body 10. Three drive shafts 26 (FIG. 7 shows only one of them), provided below the respective center axes of the outer cutters 14, project upward from the base plate 24. The drive shaft 26 is comprised of: a rotating shaft 30 that is rotationally driven by an electric motor (not shown in the drawings) housed in the shaver main body 10, a lower joint 32 fixed to the rotating shaft 30, an upper joint 34 pivotally engaging the lower joint 32, a compression coil spring 36 that urges the upper joint 34 upward, and a joint cap 38 that join the lower joint 32 and upper joint 34.

In the above-described drive shaft 26, the upper portion of the lower joint 32 is an expanded-diameter tube, and a plurality of grooves 32*a* is formed in its axial direction. The lower portion of the upper joint 34 is set to be in this expanded-diameter tube of the lower joint 32, and a plurality of projects 34*a*, which are projecting on the outer periphery of this lower portion of the upper joint 34 that is inside the lower joint 32, engage the grooves 32*a* of the lower joint 32 from the inside. The upper joint 34 is provided at its top end with an engagement head 34*c* that is substantially quadrilateral in top view and substantially spherical in side view.

The lower portion of the coil spring 36 is guided by the outer periphery of the rotating shaft 30, which projects inside the tube of the lower joint 32, and touches the inner bottom surface of the tube of the lower joint 32. The upper portion of the coil spring 36 touches the inner top surface of a spring fitting chamber 34*b* formed in the upper joint 34.

The joint cap 38 surrounds the outer perimeter of the tube of the lower joint 32 and engages the lower surface and aperture edge of the tube, so that the movement of joint cap 38 in the axial direction is restricted. As a result, the projections 34*a* of the upper joint 34 are prevented from coming out of the grooves 32*a* of the lower joint 32 in the upward direction.

An inner cutter 40 is comprised of a resin boss part 42 that opens downward (or toward the rotating shaft 30) in a cup shape and a plurality of cutter blades 44 formed so as to surround the boss part 42 and equidistantly secured circumferentially in a ring shape. The plurality of cutter blades 44 can be formed into a single body of a ring shape.

Figure 8:
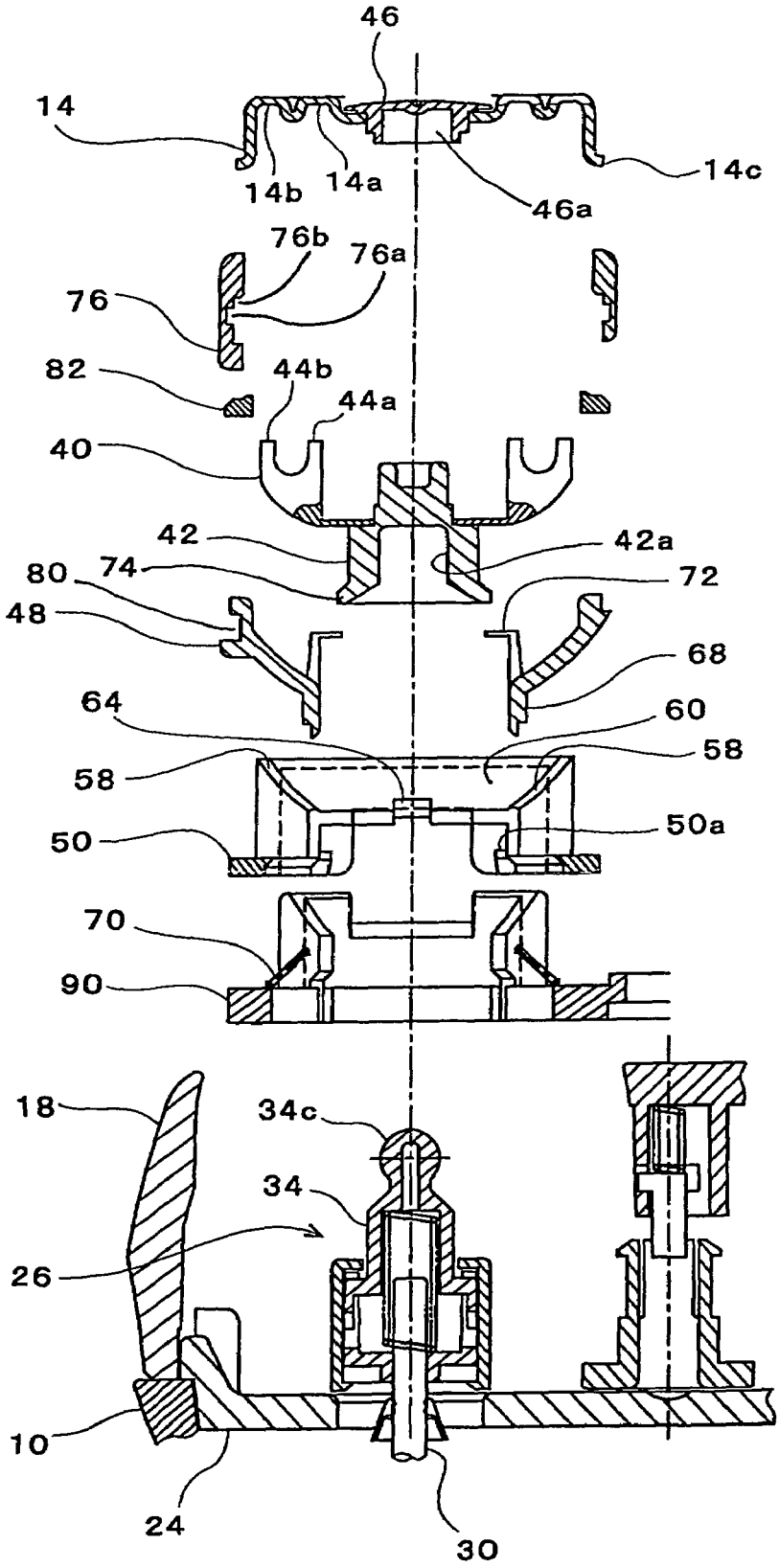
FIG. 8 is an exploded vertical cross-sectional view of one cutter unit.
Figure 10:
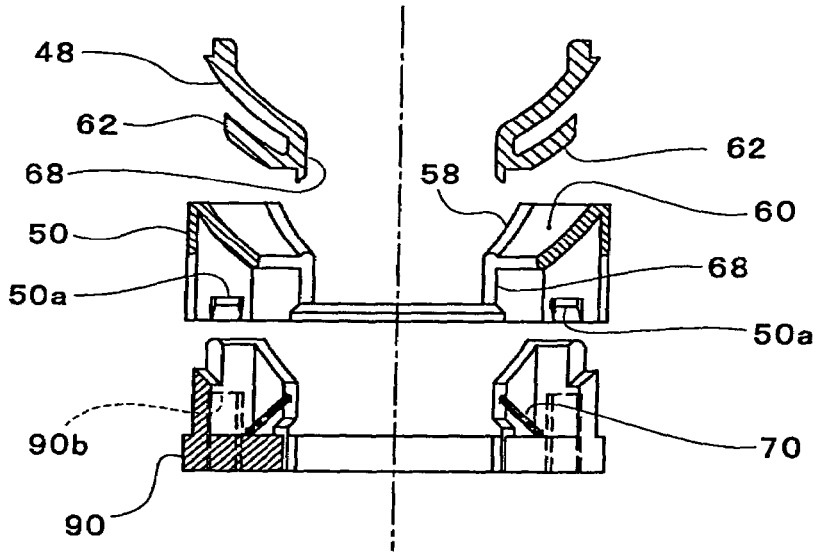
FIG. 10 is an exploded vertical cross-sectional view of one cutter without the outer and inner cutters.

As shown in FIGS. 7 and 8, ring-shaped tracks 14*a* and 14*b*, which have different diameters (or different width), are formed in the inner surface (bottom surface) of the outer cutter 14, and the upper portion of each one of the cutter blades 44 of the inner cutter 40 is bifurcated, so that the bifurcated upper portion of each one of the cutter blades 44—in other words, two cutting edges 44*a* and 44*b* (see FIG. 8)—make sliding contact from below with the tracks 14*a* and 14*b*, respectively, of the outer cutter 14.

A cap 46 that has a downwardly opening engagement hole 46*a* is attached to the center of the outer cutter 14, and as seen from FIG. 7 the upper end of the boss part 42 of the inner cutter 40 is fitted in this engagement hole 46*a;* as a result, the axial vibration of the inner cutter 40 is prevented.

As seen from FIG. 8, an engagement hole 42*a* that opens downward and has a quadrilateral shape when seen in top view is formed in the boss part 42 of the inner cutter 40, and a quadrilateral spherical engagement head 34*c* formed in the top of the upper joint 34 of the drive shaft 26 is fitted in this engagement hole 42*a* of the inner cutter 40 from below.

Figure 6:
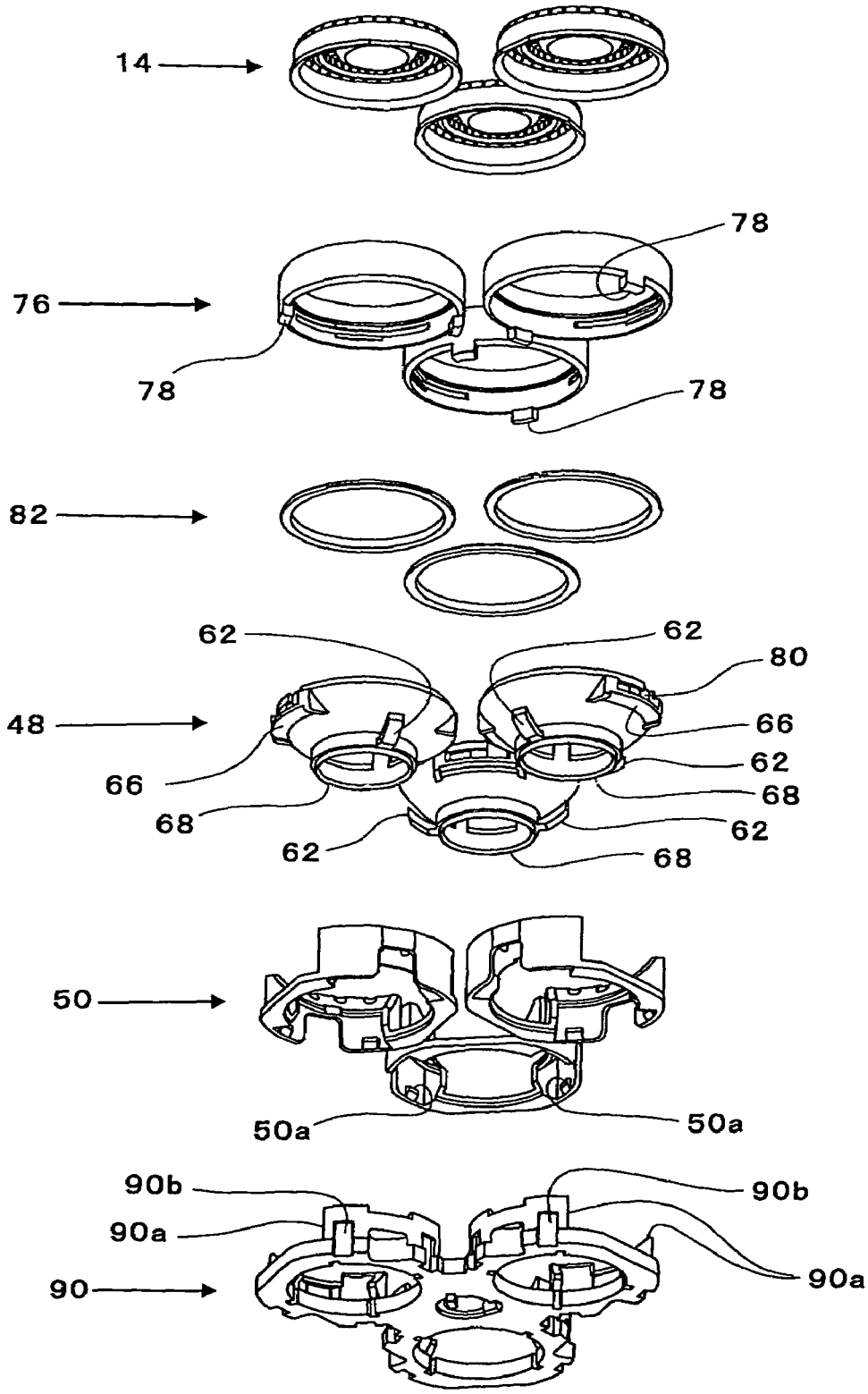
FIG. 6 is an exploded perspective view of the three cutter units seen obliquely from below.

In FIGS. 4 and 6, the reference numeral 48 is a pivot case, 50 is a pivot case holder, and 90 is a cutter receiving stage.

As seen from FIGS. 4 and 6, the pivot case 48 is formed in a substantially bowl shape that opens upward. One pivot case 48 is provided for each cutter unit 16. In other words, three pivot cases 48 are provided in the shown embodiment. Three ring-shaped cutter receiving stages 90 are connected and integrated so as to form a single body and correspond to the three cutter units 16.

Figure 11:
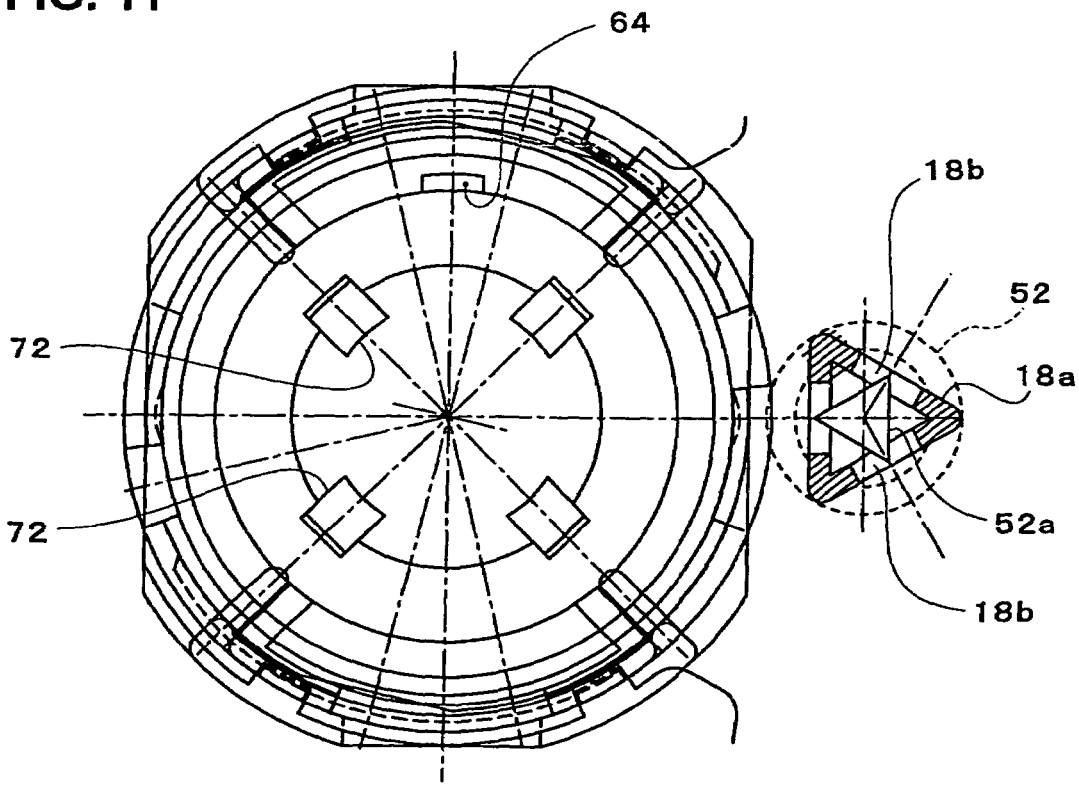
FIG. 11 is a top projection view of the pivoting case and pivot case holder assembled together.

The cutter receiving stage 90 is held in the outer cutter housing 18 that is secured to the shaver main body 10 so that the center axis of the cutter receiving stage 90 is coaxial with the drive shaft 26. More specifically, a knob 52 is provided so as to penetrate the center of the integrated cutter receiving stage 90, and the engagement part 52*a* whose tip is in a triangle shape when seen in top view (FIG. 11 shows cross section taken along the line 11-11 in FIG. 7) is integrally formed in or secured to the inside of the knob 52. The outer cutter housing 18 is formed with a center column 18*a* that is triangular when seen in top view and projects from the central inner surface of the outer cutter housing 18; and the engagement part 52*a* of the knob 52 enters into this center column 18*a* from below, so that the engagement part 52*a* of the knob 52 engages with three engagement holes 18*b* provided on the side wall of the center column 18*a*.

With the above structure, by gripping the knob 52, the engagement part 52*a* thereof is inserted into the center column 18*a* of the outer cutter housing 18 by way of matching the triangular shape of the center column 18*a* and the triangular shape of the engagement part 52*a,* and then the knob 52 is rotated about 60°; as a result, the vicinity of the triangular vertices of the engagement part 52*a* is engaged in the engagement hole 18*b* of the center column 18*a.* As a result, the cutter receiving stage 90 is held by the outer cutter housing 18 via the knob 52 (or the engagement part 52*a* thereof). In the above structure, a coil spring 54 is installed inside the center column 18*a* of the outer cutter housing 18. The coil spring 54 pushes the engagement part 52*a* of the knob 52 downward with the engagement part 52*a* of the knob 52 engaging the engagement hole 18*b* of the center column 18*a,* thus preventing the knob 52 from coming off the center column 18*a* of the outer cutter housing 18.

A claw 52*b* that engages the upper surface of the cutter receiving stage 90 is formed at the upper end of the knob 52, and a coil spring 56 is compressedly installed between the lower surface of the cutter receiving stage 90 and the bottom flange of the knob 52. As a result, the cutter receiving stage 90 is held by the knob 52 in such a manner that the cutter receiving stage 90 is sandwiched by the claw 52*b* and the coil spring 56.

The pivot case holder 50 is held in the cutter receiving stage 90 which is held, as described above, on the shaver main body 10 (in other words, held by the outer cutter housing 18) so that the pivot case holder 50 is movable slightly in the vertical direction (which is a direction parallel to the drive shaft 26). Each ring-shaped cutter receiving stage 90 has a pair of standing walls 90*a* that rise in an arc shape from symmetrical positions of the stage base 90', and downwardly opening engagement grooves 90*b* are formed at two locations of each one of the standing walls 90*a* (at a total of four locations for each cutter receiving stage 90) on the outside of the standing walls 90*a* (see FIGS. 4 and 6).

The pivot case holder 50 is substantially ring shaped, and each one of three pivot case holders 50 engages the outside of the standing walls 90*a* of the cutter receiving stage 90 with a little play in between. As seen from FIG. 6, engagement catches 50*a,* which engage the engagement grooves 90*b* of the cutter receiving stage 90, are provided at four locations on the inner peripheral surface of the pivot case holder 50. Accordingly, when the pivot case holder 50 is attached to the outer periphery of the standing walls 90*a* of the cutter receiving stage 90, the engagement catches 50*a* engage the engagement grooves 90*b,* and the pivot case holder 50 is prevented from falling or separated from the cutter receiving stage 90. The position of the engagement catches 50*a* of the pivot case holder 50 and the depth of the engagement grooves 90*b* of the cutter receiving stage 90 are set so that the pivot case holder 50 has a little play in the vertical direction (the direction parallel to the drive shaft 26) with respect to the cutter receiving stage 90.

Figure 9:
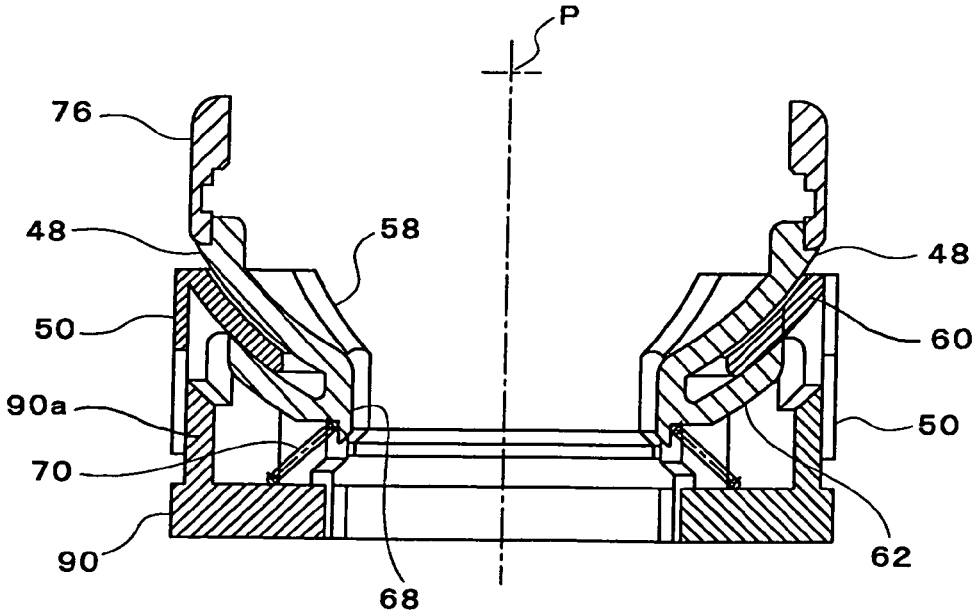
FIG. 9 is a vertical cross-sectional view of one cutter unit with the outer and inner cutters omitted.
Figure 12:
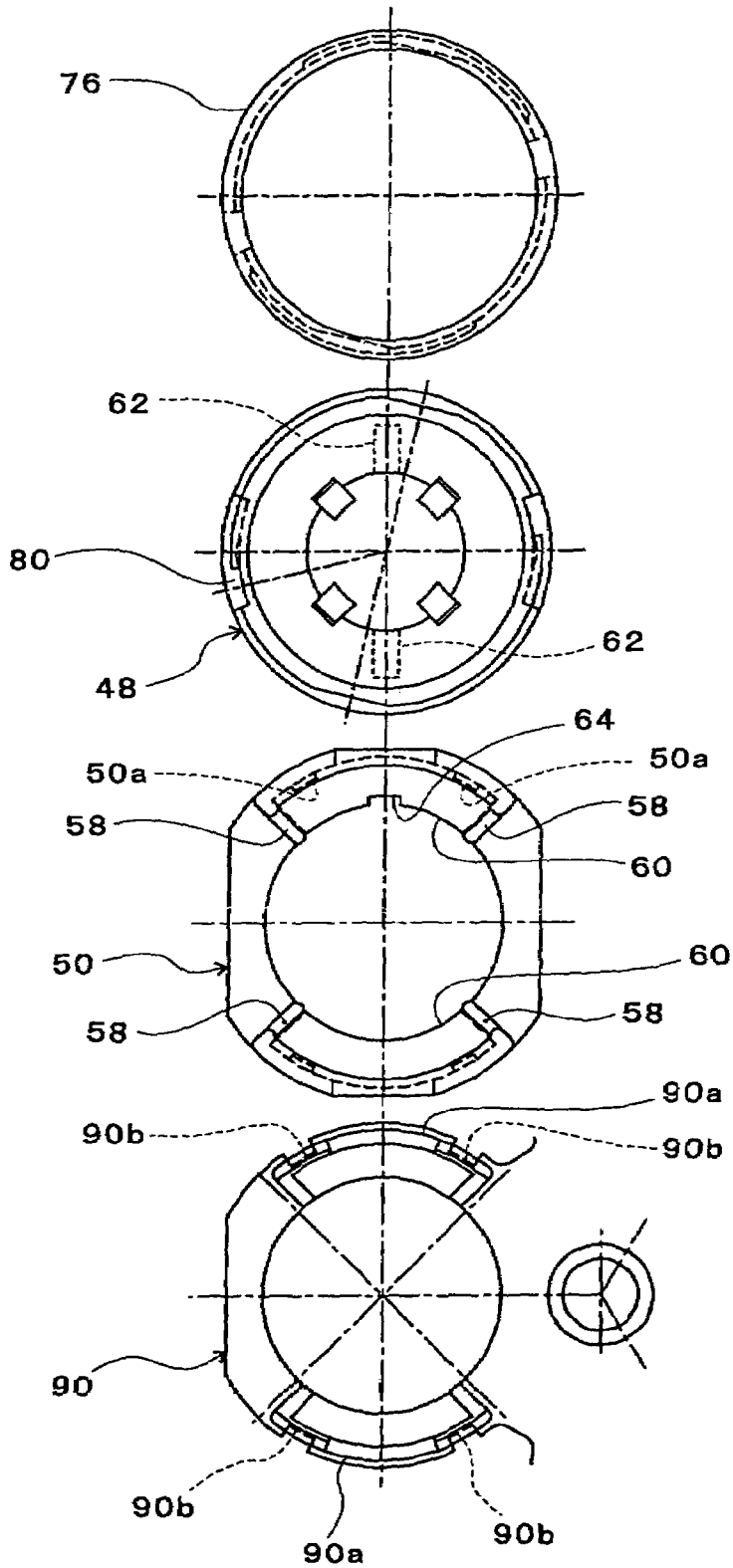
FIG. 12 is a top view of the constituting elements of one cutter unit.

The pivot case holder 50 is formed with a plurality of case supporting portions 58 (see FIGS. 4 and 12) in the upper surface. The case supporting portions 58 are positioned above the center axis of the drive shaft 26, in other words, the case supporting portions 58 are positioned on a hemispheric surface centered on the cutter axis line P (FIGS. 7 and 9) near the center top surface of the outer cutter 14. More specifically, the pivot case holder 50 has a pair of spherical plate parts 60 that are spherical and arc-shaped in top view and extend inwardly from symmetrical positions on either side of the center axis. Both circumferential edges of the two spherical plate parts 60 project slightly inward, so that a total of these four projecting edges form the case supporting portions 58. Therefore, the case supporting portions 58 arc along the spherical surface of the spherical plate part 60 and project inwardly. These case supporting portions 58 are positioned within the diameter of the outer cutter 14 and below the outer cutter 14.

The pivot case 48 is fitted in the pivot case holder 50 from above. The lower surface of the pivot case 48 is formed in a substantially hemispherical shape, and this substantially hemispherical shape lower surface of the pivot case 48 is slidably supported by the four case supporting portions 58 of the pivot case holder 50.

The pivot case 48 is formed with tongue-shaped hooks 62. The tongue-shaped hooks 62 engage the lower surface of the spherical plate part 60 of the pivot case holder 50 from the inner side of the spherical plate part 60. One hook 62 is formed for each one of two spherical plate parts 60 of each pivot case holder 50. In other words, each pivot case 48 has two tongue-shaped hooks 62. Each one of three pivot cases 48 is inserted into each one of the pivot case holders 50 from above. In the state in which one hook 62 of the pivot case 48 enters the bottom surface of one spherical plate part 60 of the pivot case holders 50 and is set to follow the spherical surface and is greatly tilted to one side, the other hook 62 is brought to pass through the cut-out 64 (FIGS. 11 and 12) formed in the other spherical plate part 60. Each pivot case 48 is thus installed in each pivot case holder 50.

As a result, the pivot case 48 is prevented from falling out of or being separated from the pivot case holder 50 upward by the two hooks 62 of the pivot case 48 and makes sliding contact from above with the case supporting portion 58 of the pivot case holder 50 and slides over the spherical surface of the spherical plate part 60 of the pivot case holder 50.

Each one of the pivot cases 48 is furthermore formed with projections 66 (FIG. 6) on the lower surface thereof so that the projections 66 restrict the pivot case 48 from overly turning in the circumferential direction. In other words, the projections 66 touch the circumferential edge of the spherical plate part 60 of the pivot case holder 50 (or touch the outside edge in the circumferential direction of the case supporting portion 58) and restrict the turning of the pivot case holder 50 in the circumferential direction.

Each pivot case 48 has a tubular part 68 (FIGS. 6-10) that projects downward and passes through the inside of the spherical plate part 60 of each pivot case holder 50. A conical coil spring 70 is provided, as best seen from FIG. 7, between the lower edge of this tubular part 68 of the pivot case 48 and the cutter receiving stage 90. The coil spring 70 provides restoration force to return the pivot case 48 to a vertical position which is shown in FIG. 7, thus being a return spring.

As seen from FIG. 4, four hooks 72 project upward from the upper edge of the tubular part 68 of the pivot case 48. The hooks 72 are bendable in the outward direction with elasticity. The tip ends of the hooks 72 are bent inwardly in a hook shape. These tip ends face the ring-shaped projection 74 (FIGS. 7 and 8) formed in the lower outer periphery of the boss part 42 of the inner cutter 40 with sufficient gap in between, thus preventing the inner cutter 40 from falling off or being separated from the pivot case 48.

The outer cutter ring 76 that includes the outer cutter 14 is detachably attached to the opening in the upper portion of the pivot case 48. More specifically, the outer cutter ring 76 engages the flange 14*c* (FIG. 8) formed in the outer periphery of the outer cutter 14 from above and surrounds the outer periphery of the outer cutter 14. Two hooks 78 projectingly provided as seen from FIG. 6 at the lower edge of the outer cutter ring 76 engage the bent engagement grooves 80 formed in the outer periphery (the outer periphery of the projection 66) of the pivot case 48. As a result, the outer cutter ring 76 is attached, together with the outer cutter 14, to the pivot case 48 detachably.

In other words, the bent engagement grooves 80 of the pivot case 48 are formed to open upward, and their lower portions are circumferentially bent in an L shape. Accordingly, the lower ends of the hooks 78 of the outer cutter ring 76 are brought to enter the bent engagement grooves 80 of the pivot case 48 from above, and the outer cutter ring 76 is turned circumferentially along the bent engagement grooves 80, thus attaching the outer cutter ring 76, together with the outer cutter 14, to the pivot case 48, so that the outer cutter ring 76 is detachably provided on the upper edge portion of the pivot case 48.

As best seen from FIG. 7, a fixing ring 82 is fitted in the inside circumferential groove 76*a* (see FIG. 8) of the outer cutter ring 76 and sandwiches the flange 14*c* of the outer cutter 14 between its upper surface and the upper step portion (see FIG. 8) of the outer cutter ring 76, so that the fixing ring 82 secures the outer cutter 14 to the outer cutter ring 76.

Next, the operation of the above-described embodiment will be described.

In the state shown in FIG. 7, in other words, when external force is not applied to the outer cutter 14, the upper joint 34 of the drive shaft 26 is urged upward by the coil spring 36, so that the inner cutter 40 and the outer cutter 14 are urged upward. The flange 14*c* of the outer cutter 14 urges the outer cutter ring 76 and the pivot case 48 upward. However, the hooks 62 of the pivot case 48 engage the lower surface of the spherical plate part 60 of the pivot case holder 50, so that the upward projecting motion of the cutter unit 16 is restricted by the hooks 62, and the cutter unit 16 is kept at the position shown in FIG. 7.

Since the pivot case holder 50 is anchored by the claw 52*b* of the knob 52, the pivot case holder 50 is prevented from moving upward (or in the direction opposite from the cutter receiving stage 90). The coil spring 54 which is fitted in the triangular column 18*a* and pushes the knob 52 downward (or in the direction toward the base plate 24) has a spring constant sufficiently large compared to the coil spring 36. The inner cutter 40 is rotated by the rotation of the drive shaft 26, and hair (whiskers, etc.) that enters the slits of the outer cutter 14 is cut by the rotating inner cutter 40.

When the external force is applied, during for instance shaving, downwardly (or in the direction toward the base plate 24) in FIG. 7 to the center or the entire surface of the outer cutter 14, the outer cutter 14 compresses the drive shaft 26 and descends within a fixed range with respect to the cutter receiving stage 90. In other words, since the flange 14*c* of the outer cutter 14 is secured to the outer cutter ring 76, the pivot case 48 to which the outer cutter ring 76 is attached is moved downward within the upward and downward play range with respect to the pivot case holder 50, and the pivot case holder 50 is moved downward within the movable range with respect to the cutter receiving stage 90, thus compressing the spring (return spring) 70 compresses.

When the downward external force is applied to only a part of the outer periphery of the outer cutter 14 (at a position away from the center), the outer cutter 14 tilts; and when the outer cutter 14 tilts, the pivot case 48 pivots together with the outer cutter ring 76. In other words, the lower surface of the pivot case 48 slides over the case supporting portion 58 of the pivot case holder 50. When this happens, the outer cutter 14 pivots while radially compressing the conical coil spring 70 about the cutter axis line P near the center of the top surface of the outer cutter 14. Therefore, the outer cutter 14 tilts in conformity to the contour of the skin, thus providing an excellent shaving feeling.

When the outer cutter 14 and the pivot case 48 tilt as described above, the upper joint 34 of the drive shaft 26 tilts in the opposite direction. In this state as well, the rotation of the drive shaft 26 is transmitted to the inner cutter 40, the cutting edges 44 and 44*b* of the inner cutter 40 make sliding contact with the inner surface (lower surface) of the tracks 14*a* and 14*b* of the outer cutter 14, so that the rotating inner cutter 40 cut the hair.

When the external force applied to the outer cutter 14 is eliminated, the pivot case 48 is pushed back in the return direction by the conical coil spring 70, the drive shaft 26 also returns to the vertical position in FIG. 7.

The invention claimed is:

1. A rotary electric shaver with a cutter unit, said cutter unit holding a substantially disk-shaped outer cutter in an outer cutter housing installed at an upper portion of a shaver main body that houses therein a motor, said cutter unit further allowing an inner cutter, which is fitted in said outer cutter from below while being pressed elastically toward said outer cutter, to rotate with a drive shaft that is rotationally driven by said motor, said cutter unit comprising:

a cutter receiving stage that is held by said outer cutter housing and is coaxially penetrated by said drive shaft, a pivot case holder that is held by said cutter receiving stage so as to be movable upward and downward, said pivot case holder having a case supporting portion located on a hemispheric surface that faces upward from below said outer cutter, a substantially bowl-shaped pivot case that is held by said pivot case holder so as to make sliding contact with said case supporting portion of said pivot case holder, said pivot case being pivotable in an arbitrary direction and surrounding a lower portion of said inner cutter, an outer cutter ring that is detachably provided on an upper edge portion of the pivot case and in which an outer peripheral edge of the outer cutter is secured to an inside thereof, and a return spring that is provided between said pivot case and said cutter receiving stage so that the return spring returns said pivot case to a position coaxial with said drive shaft; and wherein said pivot case makes sliding contact with said case supporting portion of said pivot case holder so that said pivot case is pivotable together with said outer cutter, and said pivot case is movable upward and downward together with said pivot case holder.

2. The rotary electric shaver according to claim 1, wherein a center of said hemispheric surface of said case supporting portion of said pivot case holder is provided near a center of a top surface of said outer cutter.

3. The rotary electric shaver according to claim 1, wherein said pivot case holder has a spherical plate part that extends inwardly substantially along said hemispheric surface that faces upward, and said pivot case is formed with hook means that engage a lower surface of said spherical plate part from inside.

4. The rotary electric shaver according to claim 1, wherein said case supporting portion of said pivot case holder has a rail shape along a circular arc located on said hemispheric surface.

5. The rotary electric shaver according to claim 3, wherein said pivot case has a tubular part projecting downward so as to pass through said spherical plate part of said pivot case holder, and said return spring is a conical coil spring provided between a lower end of said tubular part of said pivot case and said cutter receiving stage.

6. The rotary electric shaver according to claim 1, wherein said pivot case is provided with a plurality of hooks that project upward from an inside thereof with tip ends thereof bent inwardly, and said hooks of said pivot case engage a boss part of said inner cutter when said outer cutter is removed from said pivot case, thus preventing said inner cutter from separating from said pivot case.

7. The rotary electric shaver according to claim 1, wherein a plurality of outer cutters are provided in said outer cutter housing, and said outer cutters are, independent of one another, movable upward and downward and pivotable in an arbitrary direction.

8. The rotary electric shaver according to claim 7, wherein a plurality of said cutter receiving stages corresponding to a plurality of outer cutters are integrally formed.

9. The rotary type electric shaver according to claim 1, wherein said outer peripheral edge of said outer cutter is secured to the inside of said outer cutter ring by a fixing ring.

* * * * *